US006764815B2

(12) United States Patent
Weimann

(10) Patent No.: US 6,764,815 B2
(45) Date of Patent: Jul. 20, 2004

(54) COLOR PHOTOGRAPHIC PRINT MATERIAL

(75) Inventor: Ralf Weimann, Leverkusen (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 10/435,001

(22) Filed: May 9, 2003

(65) Prior Publication Data

US 2004/0033450 A1 Feb. 19, 2004

(30) Foreign Application Priority Data

May 13, 2002 (DE) ..... 102 21 125

(51) Int. Cl.[7] ..... G03C 1/08; G03C 7/26; G03C 7/32

(52) U.S. Cl. ..... 430/553; 430/552; 430/384; 430/385

(58) Field of Search ..... 430/552, 553, 430/384, 385

(56) References Cited

U.S. PATENT DOCUMENTS

| | | | | |
|---|---|---|---|---|
| 5,686,235 | A | 11/1997 | Lau et al. | 430/553 |
| 6,190,851 | B1 | 2/2001 | Harder et al. | |
| 6,534,254 | B1 * | 3/2003 | Helling et al. | 430/552 |
| 6,558,887 | B2 * | 5/2003 | Helling et al. | 430/552 |
| 2002/0051945 | A1 | 5/2002 | Begley et al. | |

* cited by examiner

*Primary Examiner*—Geraldine Letscher
(74) *Attorney, Agent, or Firm*—Connolly Bove Lodge & Hutz LLP

(57) ABSTRACT

A color photographic print material which contains a cyan coupler of the formula in which $R^1$ means a hydrogen atom or an alkyl group, $R^2$ means $OR^3$ or $NR^4R^5$, $R^3$ means an unsubstituted or substituted alkyl group with 1 to 6 C atoms, $R^4$ means an unsubstituted or substituted alkyl group with 1 to 6 C atoms, $R^5$ means a hydrogen atom or an unsubstituted or substituted alkyl group with 1 to 6 C atoms, $R^6$ means an unsubstituted or substituted alkyl group and Z means a hydrogen atom or a group eliminable under the conditions of chromogenic development, wherein the total number of the C atoms of the alkyl groups $R^3$ to $R^6$ in a coupler molecule is 8 to 18, is simultaneously distinguished by good light and dark stability as well as by good color reproduction. The couplers furthermore exhibit very good solubility in conventional coupler solvents.

6 Claims, No Drawings

COLOR PHOTOGRAPHIC PRINT MATERIAL

RELATED APPLICATIONS

This application claims benefit to German priority application 102 21 125.6 filed May 13, 2002, which is incorporated by reference in its entirety for all useful purposes.

BACKGROUND OF THE INVENTION

This invention relates to a color photographic print material having a novel cyan coupler.

Color photographic print materials are in particular materials for reflection prints or displays, which most usually exhibit a positive image. They are thus not a recording material like color photographic films.

Color photographic print materials conventionally contain at least one red-sensitive silver halide emulsion layer containing at least one cyan coupler, a least one green-sensitive silver halide emulsion layer containing at least one magenta coupler and at least one blue-sensitive silver halide emulsion layer containing at least one yellow coupler.

U.S. Pat. No. 5,686,235 disclosed cyan couplers which, once developed with the standard paper developer CD3, yield cyan dyes which are distinguished by good light and dark stability.

However, these couplers have the disadvantage that they exhibit poor solubility in oil formers and have a tendency to crystallise.

The couplers have a 2-acylamino-5-phenylsulfonylmethylcarbonylaminophenol structure and may be substituted on the methyl group by alkyl and on the phenyl residue by various groups.

The object of the invention was to overcome the above-stated disadvantages. This is surprisingly achieved with the novel cyan couplers defined below, while retaining the advantages of the prior art coupler.

The present invention accordingly provides a print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the cyan coupler is of the formula

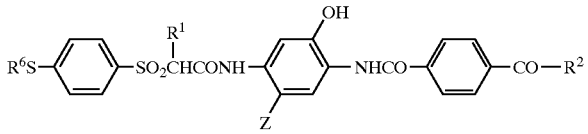

in which $R^1$ means a hydrogen atom or an alkyl group, $R^2$ means $OR^3$ or $NR^4R^5$, $R^3$ means an unsubstituted or substituted alkyl group with 1 to 6 C atoms, $R^4$ means an unsubstituted or substituted alkyl group with 1 to 6 C atoms, $R^5$ means a hydrogen atom or an unsubstituted or substituted alkyl group with 1 to 6 C atoms, $R^6$ means an unsubstituted or substituted alkyl group and Z means a hydrogen atom or a group eliminable under the conditions of chromogenic development, wherein the total number of the C atoms of the alkyl groups $R^3$ to $R^6$ in a coupler molecule is 8 to 18.

The alkyl groups can be straight chain, branched or cyclic and can be substituted, for example, by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, wherein a heterocyclyl represents a saturated, unsaturated or aromatic heterocyclic radical and an acyl represents the radical of an aliphatic, olefinic or aromatic carboxylic, carbamic, carbonic, sulphonic, amido sulphonic, phosphoric, phosphonic, phosphorous, phosphinic or sulphinic acid.

Preferably the alkyl groups can be substituted, for example, by alkyl, alkylene, hydroxy, alkoxy or acyloxy groups and most preferably by hydroxy or alkoxy groups.

Suitable cyan couplers are:

I-1

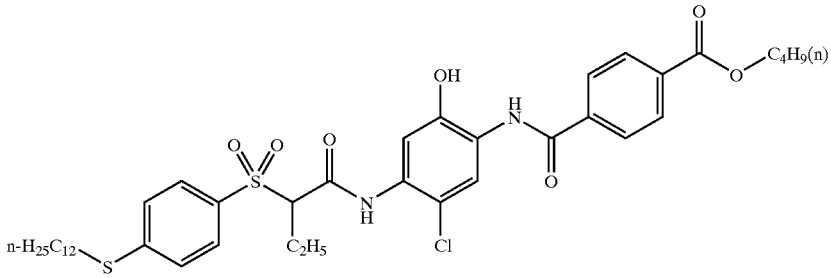

-continued
I-2
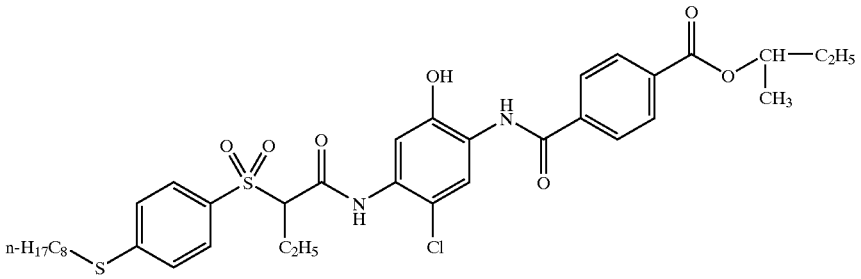
I-3
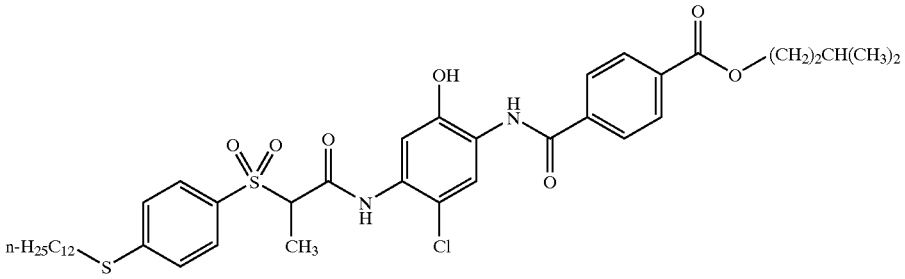
I-4
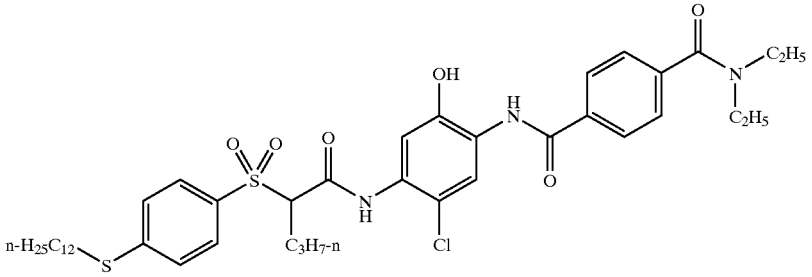
I-5
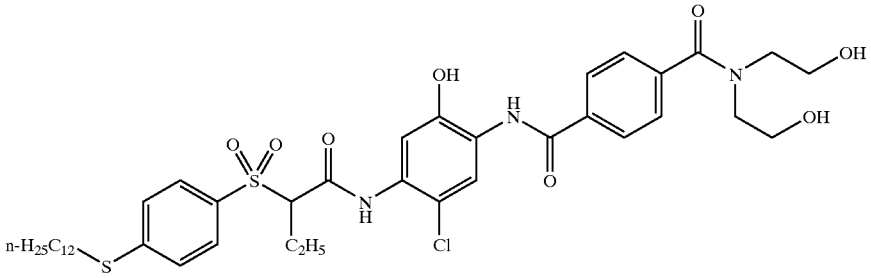
I-6
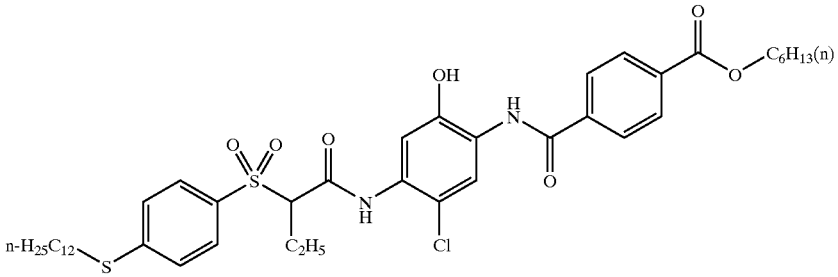

-continued
I-7
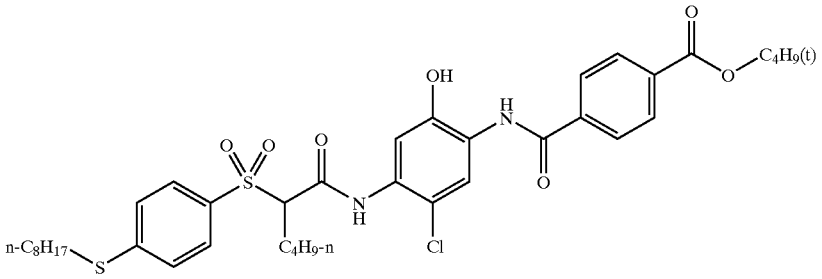
I-8
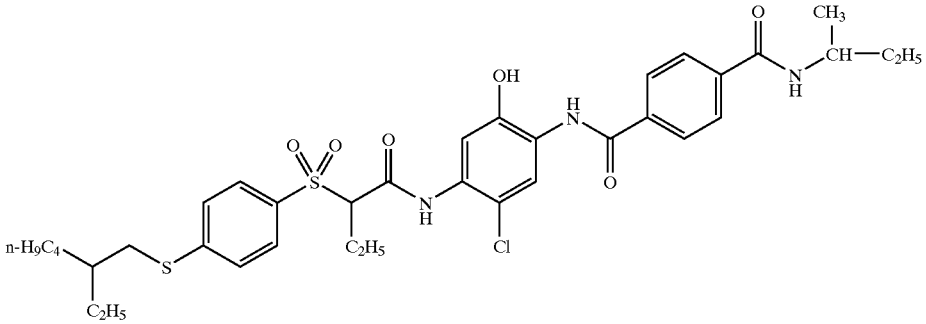
I-9
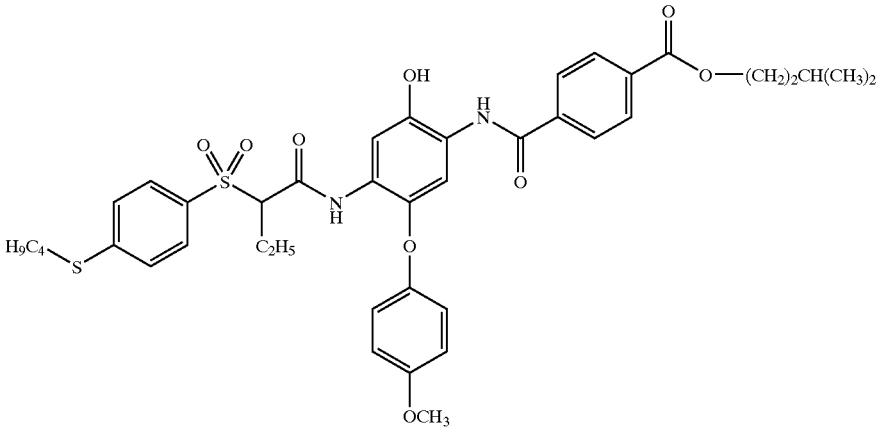
I-10
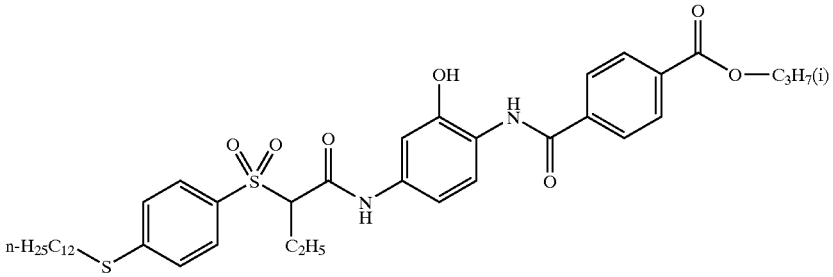
I-11
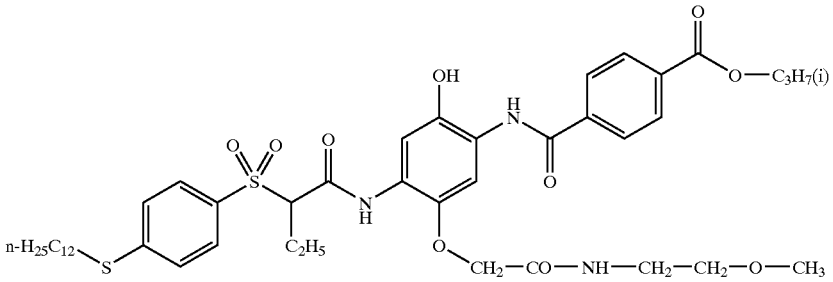

-continued
I-12
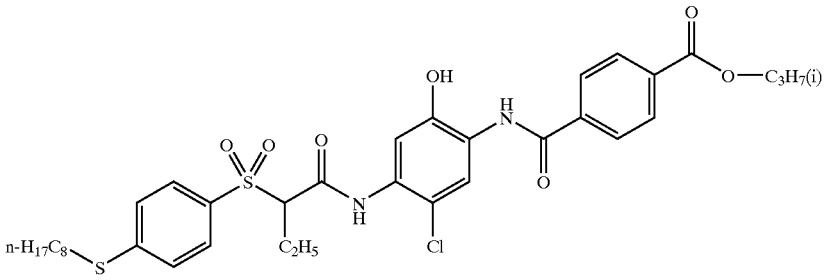
I-13
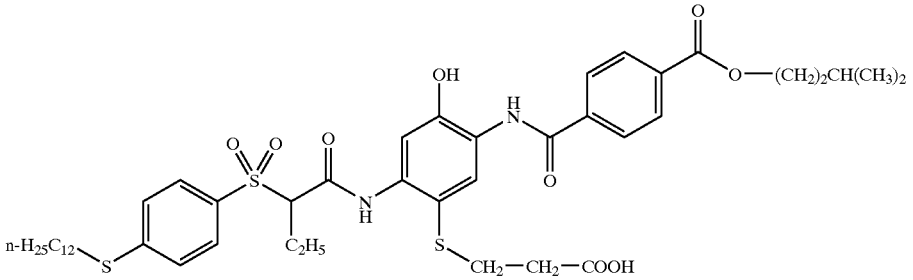
I-14
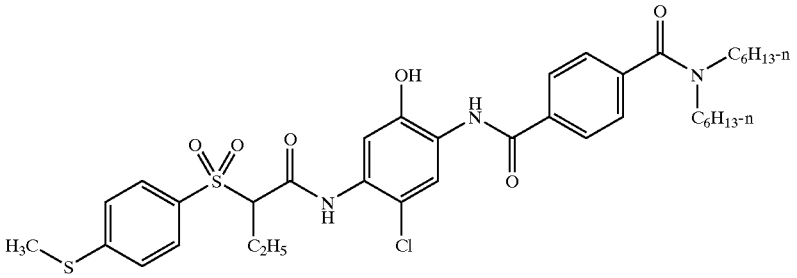
I-15
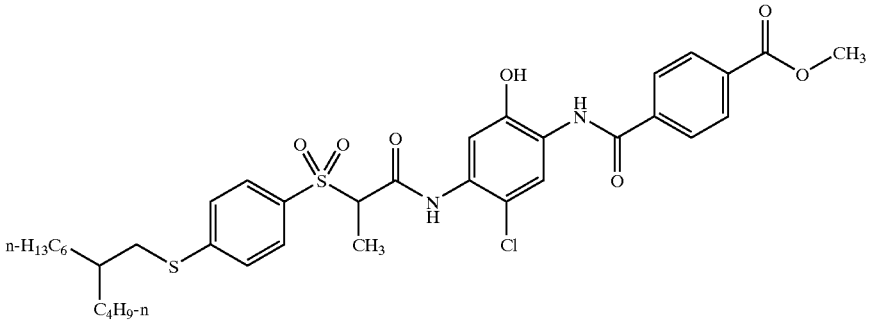
I-16
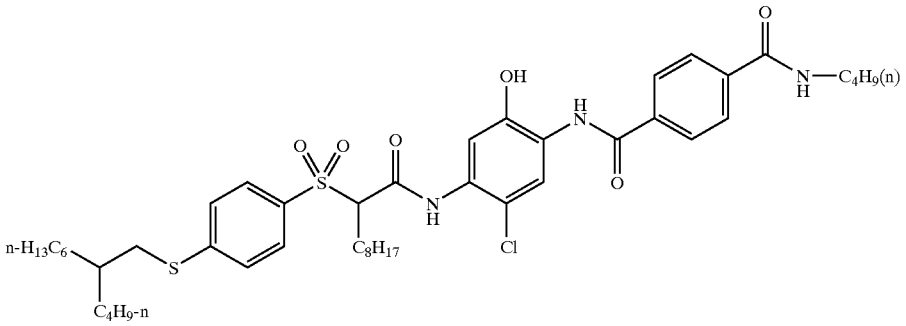

-continued
I-17
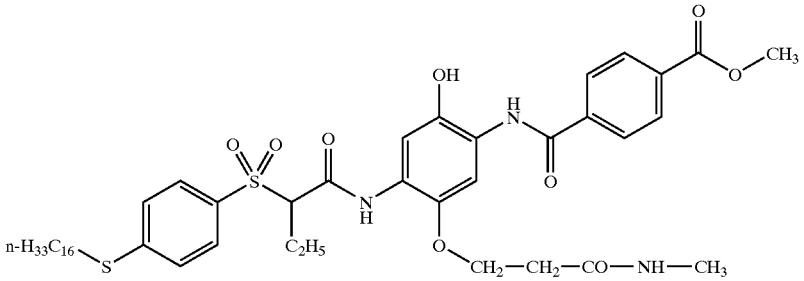
I-18
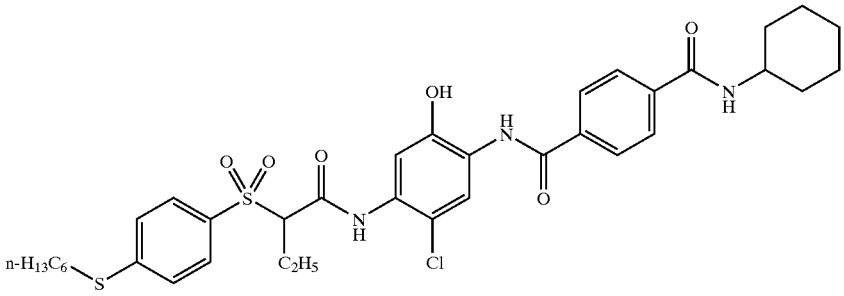
I-19
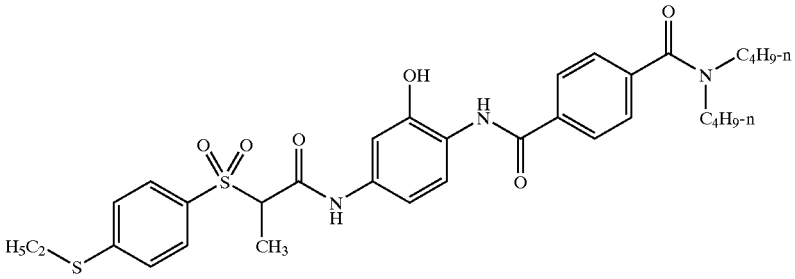
I-20
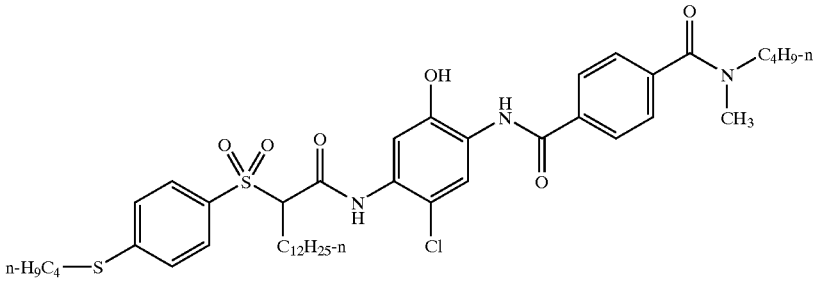
I-21
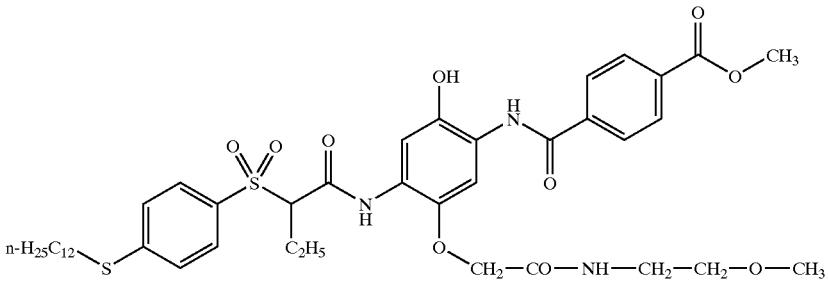

-continued
I-22
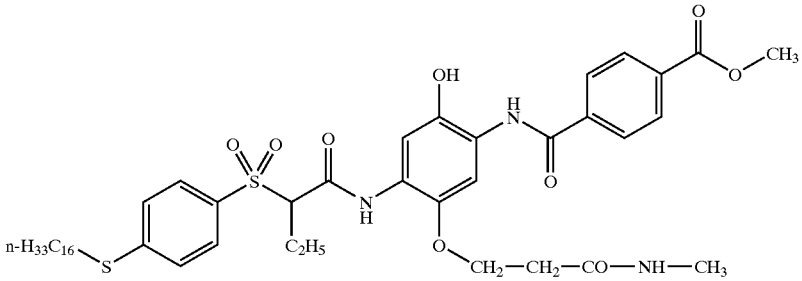
I-23
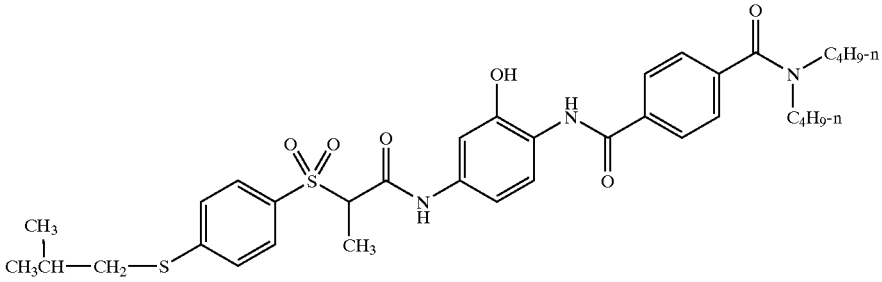
I-24
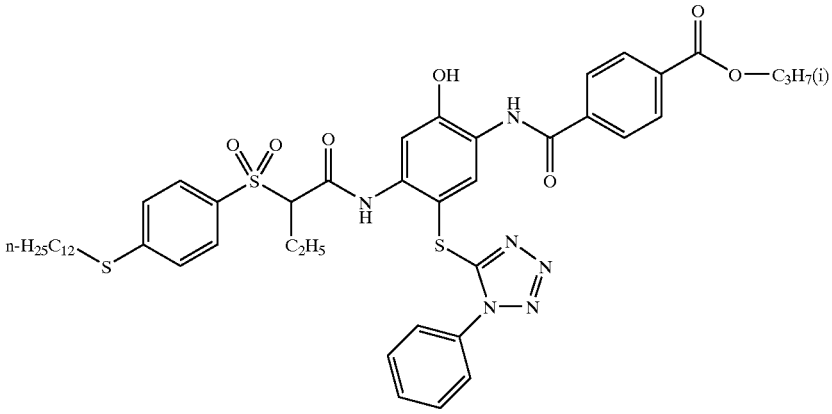
I-25
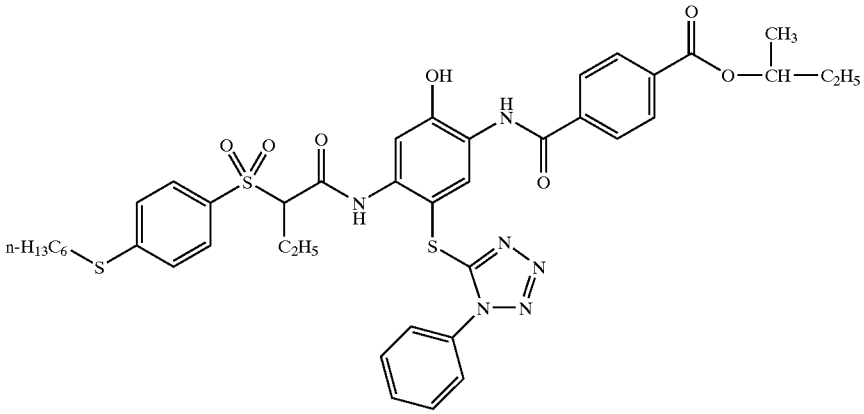

-continued
I-26
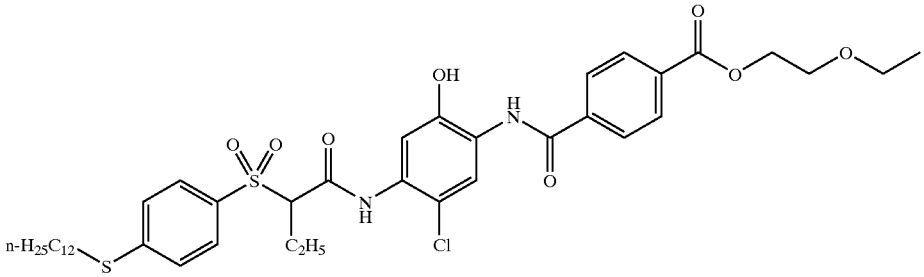
I-27
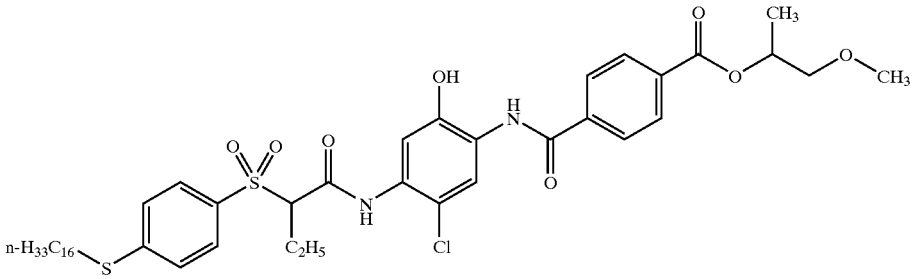
I-28
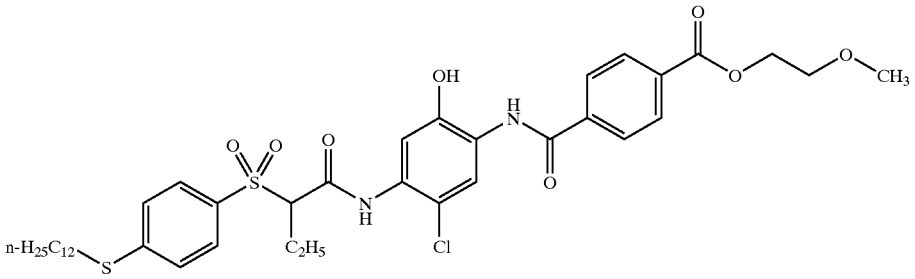
I-29
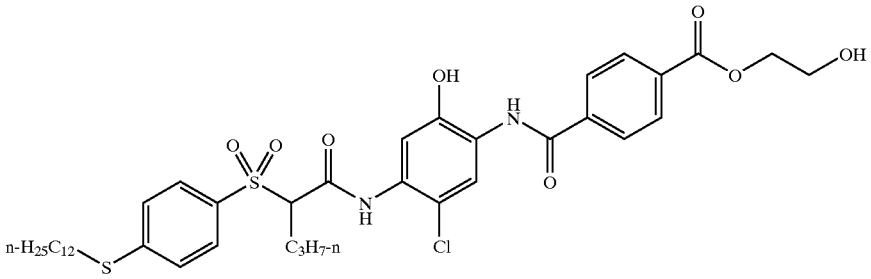
I-30
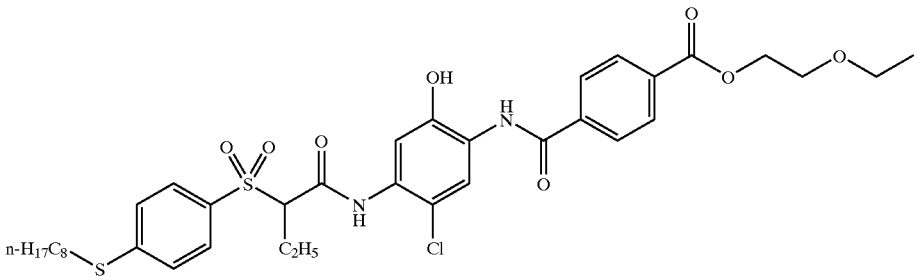

Synthesis of Coupler I-1

Synthesis of the Phenolic Coupler Intermediate

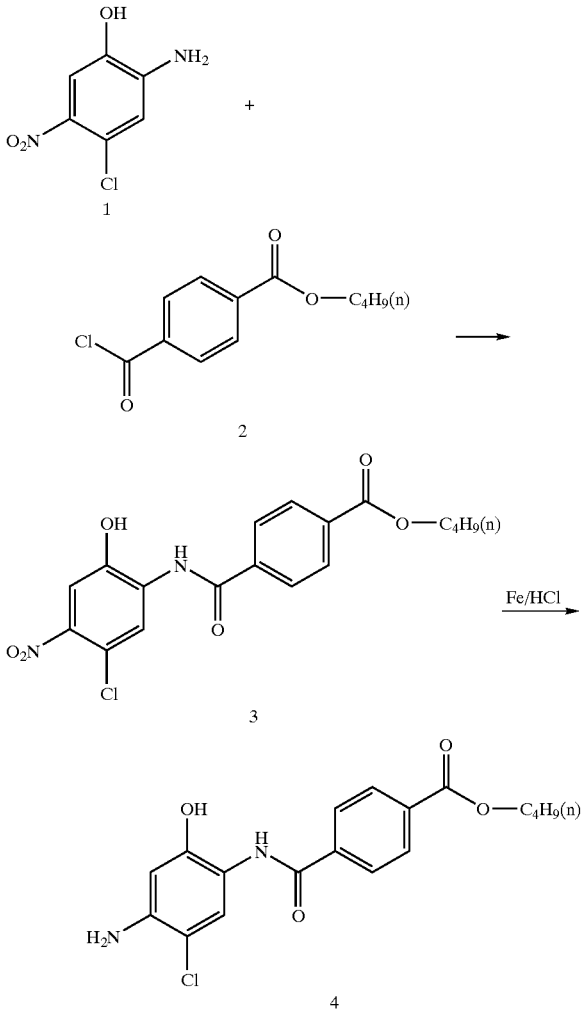

A solution of 209 g (0.87 mol) of terephthalic acid chloride monobutyl ester 2 in 50 ml of N-methylpyrrolidone is added dropwise with stirring to 165 g (0.87 mol) of 2-amino-4-chloro-5-nitrophenol 1 in 500 ml of N-methylpyrrolidone. Continue stirring for 1 hour at room temperature and then for 2 hours at 60–65° C. After cooling, slowly combine with 500 ml of water and suction filter. Stir twice with water and then twice with methanol and suction filter.

Yield 361 g (92%) of 3

A mixture of 314 g (0.80 mol) of 3, 160 g of iron powder, 2.2 l of n-butanol and 700 ml of N-methylpyrrolidone is heated to 65° C. while being stirred. The heating bath is removed and 750 ml of conc. hydrochloric acid are added dropwise within 2 hours. The mixture is then refluxed for 1 hour. After cooling, 1 l of water is added, the mixture suction filtered and washing performed with 2 N hydrochloric acid, then with water until the outflowing water is colorless. The residue is stirred together with 1.5 l of water, the mixture neutralised by addition of sodium acetate and suction filtered. Stir twice more with 1.5 l of methanol and suction filter.

Yield 255 g (88%) of 4

Synthesis of the Ballast Residue

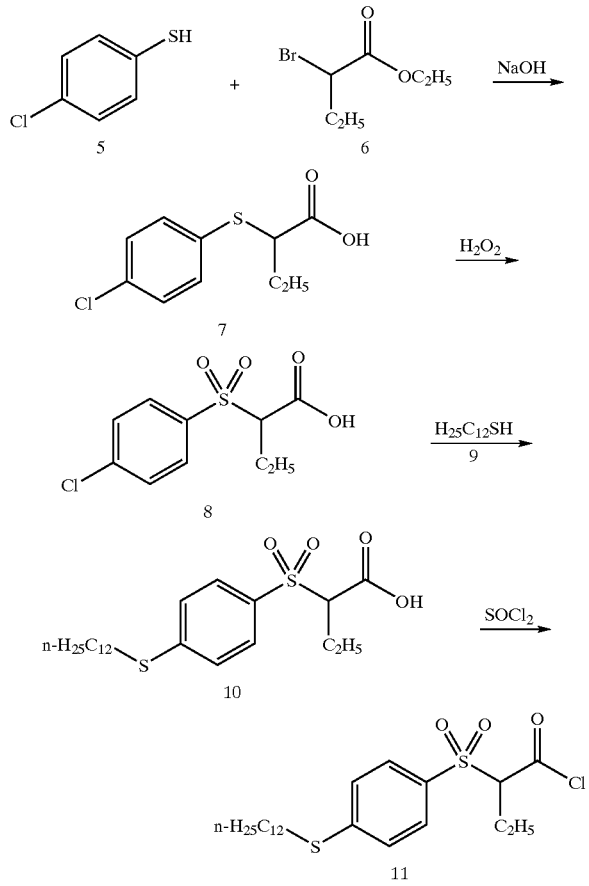

320 g (3.6 mol) of 45% sodium hydroxide solution are added dropwise within 1 hour with stirring to a mixture of 520 g (3.6 mmol) of 4-chlorothiophenol 5 and 652 g (3.6 mol) of 2-bromobutyric acid ethyl ester 6 in 1 l of ethanol. The reaction is strongly exothermic, the temperature being kept at 75–80° C. by cooling, and the mixture is then refluxed for 1 hour. A further 400 g (4.5 mol) of sodium hydroxide solution are slowly added dropwise (weakly exothermic). After refluxing for a further 2 hours, the mixture is cooled and 1 l of water is added. Extraction is then performed twice with 250 ml of toluene, the combined organic phases are dried and evaporated in the rotary evaporator. The viscous oil 7 (830 g, still contains toluene) is further reacted without purification.

760 ml of hydrogen peroxide (35%) are added dropwise to a solution of 830 g (3.6 mol) of compound 7 and 10 ml of sodium tungstate solution (20%) in glacial acetic acid: the first 300 ml initially with cooling at 35–40° C. and, after removal of the cooling, the remaining 360 ml at 90–95° C. Once addition is complete, stirring is continued for 1 hour at this temperature. Excess peroxide is destroyed by addition of sodium sulfite. The reaction mixture is combined with 2 l of ethyl acetate and 2 l of water, the organic phase is separated and the aqueous phase extracted twice with 700 ml portions of ethyl acetate. The combined organic phases are washed twice with 700 ml portions of water, dried and evaporated under a vacuum. The residue is dissolved in 300 ml of hot ethyl acetate, cooled and, at the onset of crystallisation, combined with 1 l of hexane. The mixture is then suction filtered when cold and rewashing performed with a little hexane. 835 g (88%) of the compound 8 are obtained.

131 g (0.5 mol) of 8 and 111 g (0.55 mol) of dodecyl mercaptan 9 in 300 ml of 2-propanol are combined with stirring with 90 g (1 mol) of sodium hydroxide solution (45%). After the addition of 2.5 g of tetrabutylammonium bromide and 2.5 g of potassium iodide, the mixture is refluxed for 11 hours. After cooling, 350 ml of water are added and the pH is adjusted to 1–2 with approx. 60 ml of conc. hydrochloric acid. Extraction is then performed twice with 100 ml portions of ethyl acetate, the combined organic phases are washed three times with 150 ml portions of water, dried and evaporated. The residue is stirred together with 500 ml of hexane and the mixture suction filtered at 0–5° C. After recrystallisation from 500 ml of hexane/ethyl acetate (10:1), 177 g of 10 are obtained (82%, m.p.: 82° C.).

128 g (0.3 mol) of 10 and 1 ml of dimethylformamide are heated to 65° C. in 300 ml of toluene. 75 ml (1 mol) of thionyl chloride are added dropwise at this temperature within 1 hour. After a further 5 hours, the mixture is evaporated under a vacuum. The highly viscous oil (11, 134 g) is used without further purification.

Synthesis of Coupler I-1

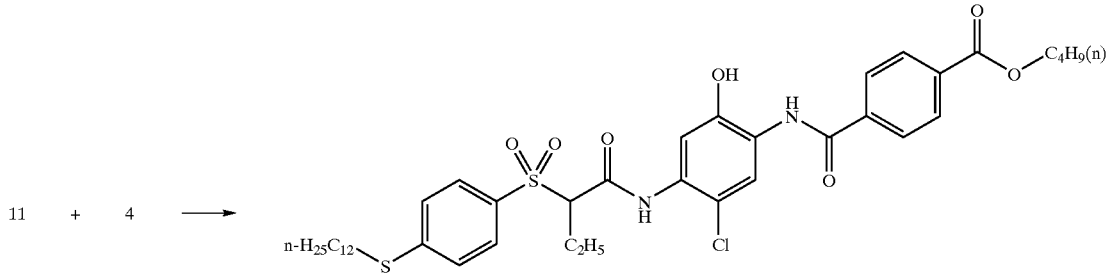

I-1

150 g of the crude product 11 (approx. 0.3 mol) in 150 ml of N-methylpyrrolidone are added dropwise at 5–10° C. to 109 g (0.3 mol) of 4 in 200 ml of N-methylpyrrolidone. The mixture is stirred, initially for 2 hours at room temperature, then for 2 hours at 60° C. After addition of 1000 ml of ethyl acetate, the mixture is washed twice with dilute hydrochloric acid and twice with water. The organic phase is dried, evaporated and redissolved in 700 ml of acetonitrile. Coupler I-1 crystallises out. This mixture is suction filtered and rewashing is performed with 50 ml of acetonitrile.

Yield: 136 g (75%) of I-1

Examples of color photographic print materials are color photographic paper, color reversal photographic paper and semi-transparent display material. A review may be found in Research Disclosure 37038 (1995), Research Disclosure 38957 (1996) and Research Disclosure 40145 (1997).

Photographic print materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The color photographic print materials conventionally contain at least one red-sensitive, one green-sensitive and one blue-sensitive silver halide emulsion layer, optionally together with interlayers and protective layers.

Depending upon the type of photographic print material, these layers may be differently arranged. This is demonstrated for the most important products:

Color photographic paper and color photographic display material conventionally have on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; a yellow filter layer is not necessary.

The number and arrangement of the photosensitive layers may be varied in order to achieve specific results. Color papers, for example, may also contain differently sensitised interlayers, by means of which gradation may be influenced.

The substantial constituents of the photographic emulsion layers are binder, silver halide grains and color couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Further red sensitisers which may be considered for the red-sensitive layer are pentamethinecyanines having naphthothiazole, naphthoxazole or benzothiazole as basic end groups, which may be substituted with halogen, methyl or methoxy groups and may be bridged by 9,11-alkylene, in particular 9,11-neopentylene. The N,N' substituents may be $C_4$–$C_8$ alkyl groups. The methine chain may additionally also bear substituents. Pentamethines having only one methyl group on the cyclohexene ring may also be used. The red sensitiser may be supersensitised and stabilised by the addition of heterocyclic mercapto compounds.

The red-sensitive layer additionally be spectrally sensitised between 390 and 590 nm, preferably at 500 nm, in order to bring about improved differentiation of red tones.

The spectral sensitisers may be added to the photographic emulsion in dissolved form or as a dispersion. Both the solution and dispersion may contain additives such as wetting agents or buffers.

The spectral sensitiser or a combination of spectral sensitisers may be added before, during or after preparation of the emulsion.

Photographic print materials contain either silver chloride-bromide emulsions containing up to 80 mol % of AgBr or silver chloride-bromide emulsions containing above 95 mol % of AgCl.

Details of color couplers may be found in Research Disclosure 37254, part 4 (1995), page 288, in Research Disclosure 37038, part II (1995), page 80 and in Research Disclosure 38957, part X.B (1996), page 616. In print materials, the maximum absorption of the dyes formed from the couplers and the color developer oxidation product is preferably within the following ranges: yellow coupler 440 to 450 nm, magenta coupler 540 to 560 nm, cyan coupler 625 to 670 nm.

The yellow couplers associated with a blue-sensitive layer in print materials are almost always two-equivalent couplers of the pivaloylacetanilide and cyclopropylcarbonylacetanilide series.

The magenta couplers conventional in print materials are almost always those from the series of anilinopyrazolones, pyrazolo[5,1-c](1,2,4)triazoles or pyrazolo[1,5-b](1,2,4) triazoles.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce color fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, XI and X (1996), pages 607 and 610 et seq.

The layers of color photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, color photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX and XX (1996), pages 630 et seq. together with example materials.

EXAMPLES

Example 1

A color photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

| Layer structure 101 | |
|---|---|
| Layer 1: | (substrate layer) |
| | 0.10 g of gelatine |
| Layer 2: | (blue-sensitive layer) |
| | Blue-sensitive silver halide emulsion (99.5 mol % chloride, 0.5 mol % bromide, average grain diameter 0.75 μm) prepared from 0.4 g of $AgNO_3$. |
| | 1.25 g of gelatine |
| | 0.50 g of yellow coupler GB-1 |
| | 0.30 g of tricresyl phosphate (TCP) |
| | 0.10 g of stabiliser ST-1 |
| Layer 3: | (interlayer) |
| | 0.10 g of gelatine |
| | 0.06 g of DOP scavenger SC-1 |
| | 0.06 g of DOP scavenger SC-2 |
| | 0.12 g of TCP |
| Layer 4: | (green-sensitive layer) |
| | Green-sensitive silver halide emulsion (99.5 mol % chloride, 0.5 mol % bromide, average grain diameter 0.45 μm) prepared from 0.2 g of $AgNO_3$. |
| | 1.10 g of gelatine |
| | 0.15 g of magenta coupler PP-1 |
| | 0.15 g of stabiliser ST-2 |
| | 0.20 g of stabiliser ST-3 |
| | 0.40 g of TCP |
| Layer 5: | (UV protective layer) |
| | 1.05 g of gelatine |
| | 0.35 g of UV absorber UV-1 |
| | 0.10 g of UV absorber UV-2 |
| | 0.05 g of UV absorber UV-3 |
| | 0.06 g of DOP scavenger SC-1 |
| | 0.06 g of DOP scavenger SC-2 |
| | 0.25 g of TCP |
| Layer 6: | (red-sensitive layer) |
| | Red-sensitive silver halide emulsion (99.5 mol % chloride, 0.5 mol % bromide, average grain diameter 0.48 μm) prepared from 0.28 g of $AgNO_3$. |
| | 1.00 g of gelatine |
| | 0.36 g of cyan coupler BG-1 |
| | 0.30 g of TCP |
| Layer 7: | (UV protective layer) |
| | 1.05 g of gelatine |
| | 0.35 g of UV absorber UV-1 |
| | 0.10 g of UV absorber UV-2 |
| | 0.05 g of UV absorber UV-3 |
| | 0.15 g of TCP |
| Layer 8: | (protective layer) |
| | 0.90 g of gelatine |
| | 0.05 g of optical brightener W-1 |
| | 0.07 g of polyvinylpyrrolidone |
| | 1.20 ml of silicone oil |
| | 2.50 mg of polymethyl methacrylate spacers, average particle size 0.8 μm |
| | 0.30 g of instant hardener H-1 |

The other layer structures differ from 101 with regard to the cyan couplers and the oil formers (coupler solvents); C are Comparative Examples; I are Examples according to the invention.

A sample of each is stored, unprocessed, in darkness at 5° C.

Processing:

Samples of the material are exposed under a grey wedge through a red filter and processed as follows.

| a) | Color developer - 45 s - 35° C. | |
|---|---|---|
| | Triethanolamine | 9.0 g |
| | N,N-Diethylhydroxylamine | 4.0 g |

-continued

| | | |
|---|---|---|
| | Diethylene glycol | 0.05 g |
| | 3-Methyl-4-amino-N-ethyl-N-methane-sulfonamidoethylaniline sulfate | 5.0 g |
| | Potassium sulfite | 0.2 g |
| | Triethylene glycol | 0.05 g |
| | Potassium carbonate | 22 g |
| | Potassium hydroxide | 0.4 g |
| | Ethylenediaminetetraacetic acid, disodium salt | 2.2 g |
| | Potassium chloride | 2.5 g |
| | 1,2-Dihydroxybenzene-3,4,6-trisulfonic acid trisodium salt | 0.3 g |
| | make up with water to 1000 ml; pH 10.0 | |
| b) | Bleach/fixing bath - 45 s - 35° C. | |
| | Ammonium thiosulfate | 75 g |
| | Sodium hydrogen sulfite | 13.5 g |
| | Ammonium acetate | 2.0 g |
| | Ethylenediaminetetraacetic acid (iron/ammonium salt) | 57 g |
| | Ammonia, 25% | 9.5 g |
| | make up with acetic acid to 1000 ml; pH 5.5 | |

-continued

| | |
|---|---|
| c) | Rinsing - 2 min - 33° C. |
| d) | Drying |

The percentage yellow and magenta secondary densities were then determined at cyan density $D_{cyan}$=1.0 ($SD_{yellow}$, $SD_{magenta}$). The results are shown in Table 1. The samples are also stored in darkness for 42 days at 85° C. and 60% relative humidity and the percentage reductions in density at maximum density ($\Delta D_{max}$) were determined. Further samples are exposed to 15–$10^6$lux·h of light from a daylight-standardised xenon lamp at 35° C. and 85% relative humidity. The reduction in density at D=0.6 is then determined [$\Delta D_{0.6}$].

The undeveloped wedges on the samples which have been stored in the cold are investigated for unwanted crystallisation of the cyan coupler.

The following compounds are used in Example 1:

GB-1

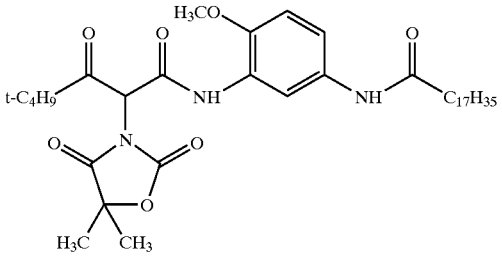

PP-1

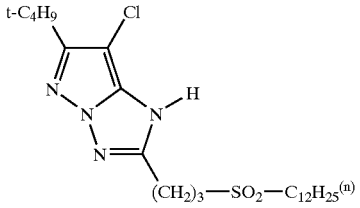

BG-1

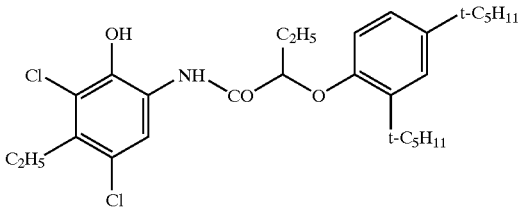

BG-2

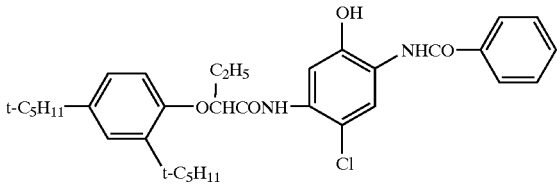

BG-3

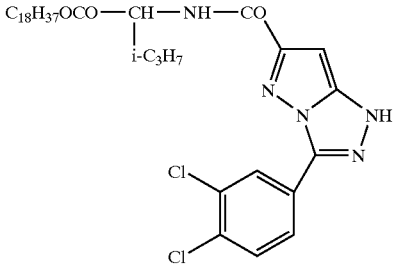

BG-4

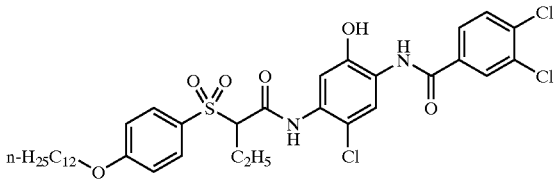

SC-1

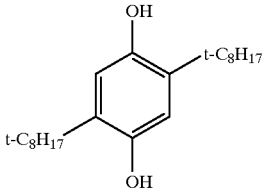

SC-2

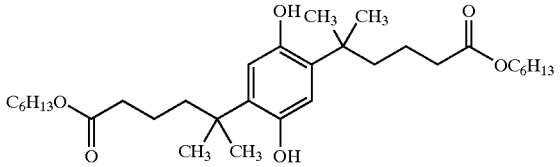

-continued
UV-1
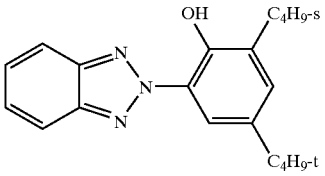
UV-2
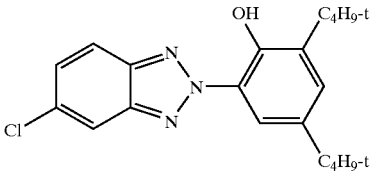
UV-3
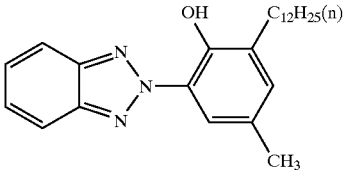
H-1
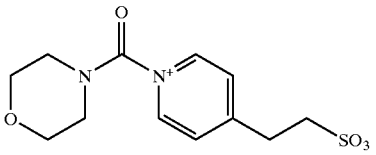
ST-1
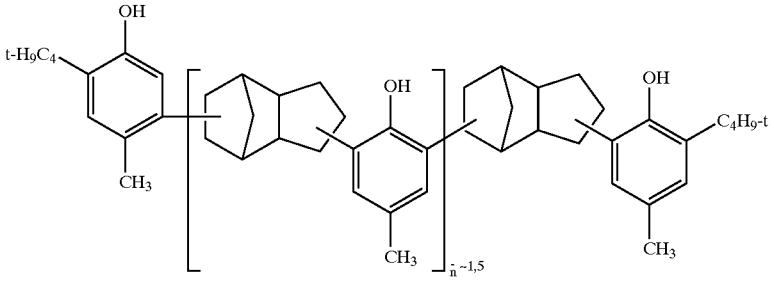
ST-2
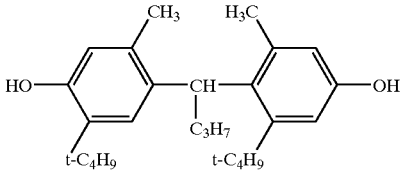
ST-3
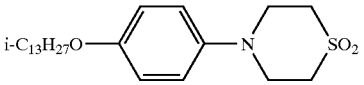
W-1
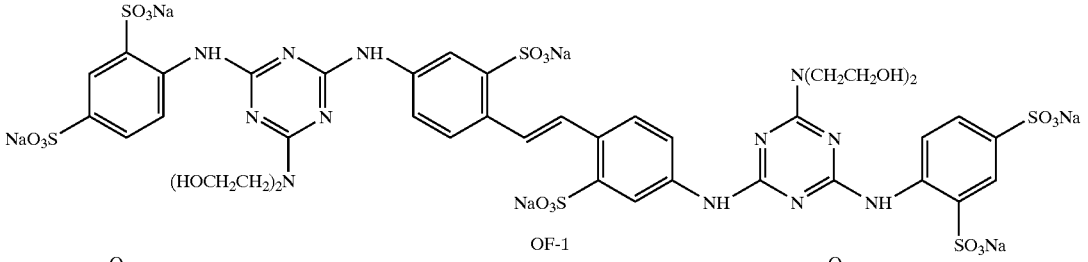
OF-1
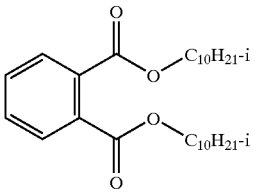
OF-2
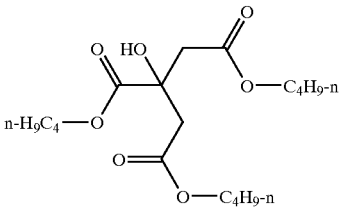
OF-3
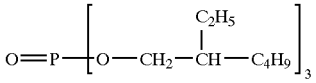
TABLE 1
| Layer structure | Layer 6 Cyan coupler | Secondary density (%) $SD_{yellow}$ | $SD_{magenta}$ | Dark stability $\Delta D_{max}$(%) | Light stability $\Delta D_{0.6}$(%) | Cold storage |
|---|---|---|---|---|---|---|
| 101(V) | BG-1 | 11.9 | 28.9 | −38 | −27 | — |
| 102(C) | BG-2 | 12.9 | 37.5 | −5 | −35 | — |
| 103(C) | BG-3 | 10.1 | 24.5 | −19 | −80 | — |

TABLE 1-continued

| Layer structure | Layer 6 Cyan coupler | Secondary density (%) $SD_{yellow}$ | $SD_{magenta}$ | Dark stability $\Delta D_{max}$(%) | Light stability $\Delta D_{0.6}$(%) | Cold storage |
|---|---|---|---|---|---|---|
| 104(C) | BG-4 | 10.3 | 23.7 | * | −27 | distinct crystallisation |
| 105(C) | BG-4 (but OF-1) | 10.2 | 23.5 | * | −28 | distinct crystallisation |
| 106(C) | BG-4 (but OF-2) | 9.7 | 23.1 | * | −30 | distinct crystallisation |
| 107(C) | BG-4 (but OF-3) | 10.3 | 24.5 | * | −28 | distinct crystallisation |
| 108(I) | I-1 | 10.7 | 25.7 | −8 | −37 | — |
| 109(I) | I-2 | 10.6 | 25.3 | −9 | −32 | — |
| 110(I) | I-3 | 10.8 | 26.3 | −9 | −39 | — |
| 111(I) | I-5 | 11.5 | 23.7 | −12 | −29 | — |
| 112(I) | I-11 | 10.3 | 26.4 | −9 | −35 | — |
| 113(I) | I-14 | 10.9 | 26.8 | −10 | −33 | — |
| 114(I) | I-15 | 11.1 | 26.9 | −11 | −36 | — |
| 115(I) | I-18 | 11.3 | 25.1 | −7 | −34 | — |
| 116(I) | I-21 | 11.3 | 26.7 | −8 | −37 | — |
| 117(I) | I-22 | 10.9 | 26.8 | −9 | −32 | — |

*Dye exudes from the layered structure, i.e. comes to the surface and can be wiped off.

In addition to disadvantages with regard to absorption, the conventional phenolic cyan coupler (BG-1) exhibits very distinct disadvantages with regard to dark stability, while, on the other hand, the diacylaminophenol cyan coupler (BG-2) exhibits distinct shortcomings with regard to light stability. This shortcoming is still more marked in the case of the heterocyclic coupler (BG-3). The diacylaminophenol cyan couplers according to U.S. Pat. No. 5,686,235 (BG-4) exhibit advantages with regard to absorption and light stability. However, the extremely sparing solubility of these compounds is disadvantageous. After cold storage of the unprocessed material (even in various oil formers), the coupler had in each case crystallised out. Disadvantages were also encountered in the hot cabinet. The dyes formed from both couplers are probably equally sparingly soluble in the oil formers. The oil former is incapable of retaining the dyes in the cyan layer and they diffuse to the surface, where they can be wiped off.

Only the couplers according to the invention exhibit excellent solubility in the oil former. The dyes formed therefrom are simultaneously distinguished by good light stability, excellent dark stability and good color reproduction.

All the references described herein are incorporated by reference in its entirety for all useful purposes.

What is claimed is:

1. A color photographic print material which comprises at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, wherein the cyan coupler is of the formula

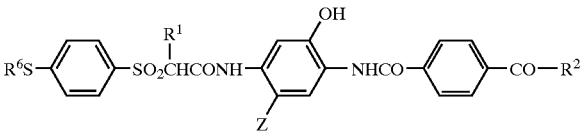

in which $R^1$ is a hydrogen atom or an alkyl group, $R^2$ is $OR^3$ or $NR^4R^5$, $R^3$ is an unsubstituted or substituted alkyl group with 1 to 6 C atoms, $R^4$ is an unsubstituted or substituted alkyl group with 1 to 6 C atoms, $R^5$ is a hydrogen atom or an unsubstituted or substituted alkyl group with 1 to 6 C atoms, $R^6$ is an unsubstituted or substituted alkyl group and Z is a hydrogen atom or a group eliminable under the condition of chromogenic development, wherein the total number of the C atoms of the alkyl groups $R^3$ to $R^6$ in a coupler molecule is 8 to 18.

2. The color photographic print material as claimed in claim 1, wherein said alkyl is a straight chain, branched or cyclic and can is optionally substituted by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, and wherein said heterocyclyl, heterocyclyloxy, heterocyclylthio and heterocyclylseleno contain a hetero atom selected form the group consisting of S, O, N or P atom.

3. The color photographic print material as claimed in claim 1, wherein said alkyl is a straight chain, branched or cyclic and can is optionally substituted by alkyl groups is substituted by alkyl, alkylene, hydroxy, alkoxy or acyloxy groups.

4. The color photographic print material as claimed in claim 1, wherein said alkyl is a straight chain, branched or cyclic and can is optionally substituted by hydroxy or alkoxy groups.

5. The color photographic print material as claimed in claim 1, wherein Z is

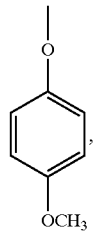

O—$CH_2$—CO—NH—$CH_2$—$CH_2$—O—$CH_3$,
S—$CH_2$—$CH_2$—COOH or
O—$CH_2CH_2$—CO—NH—$CH_3$.
6. The color photographic print material as claimed in claim 1, wherein said cyan couplers is one coupler selected from the group consisting of I-1–I-30.
I-1
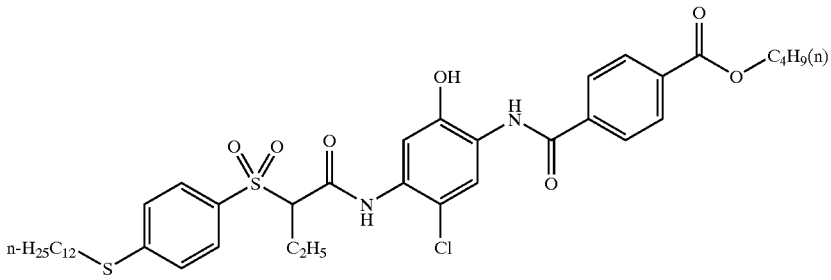
I-2
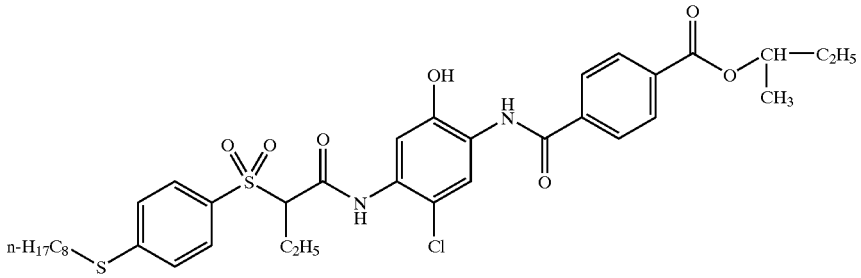
I-3
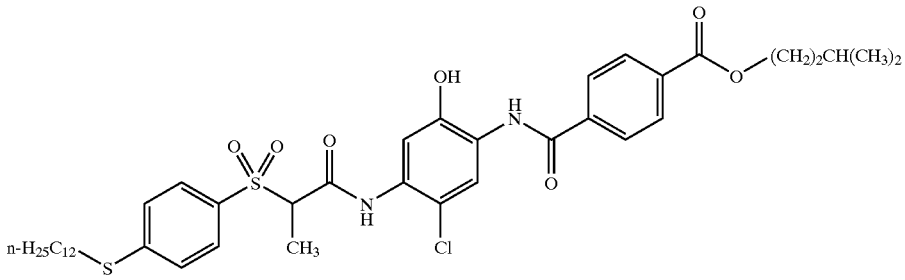
I-4
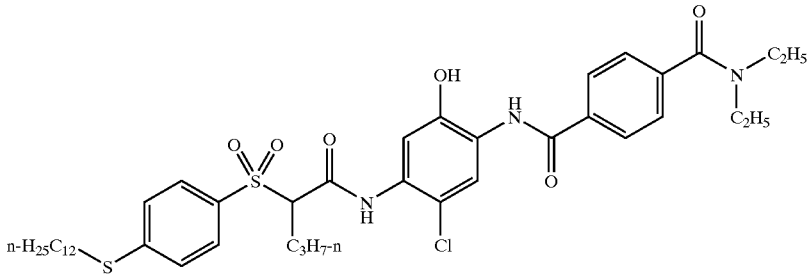

-continued
I-5
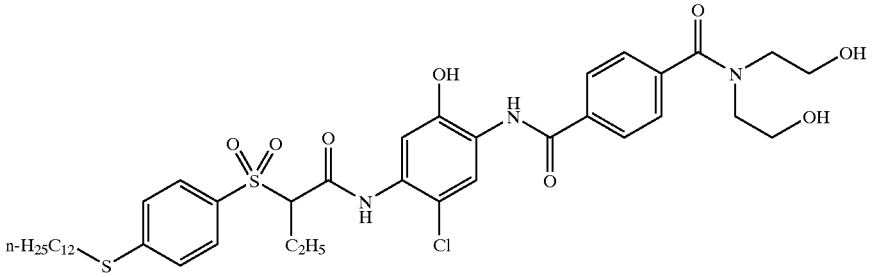
I-6
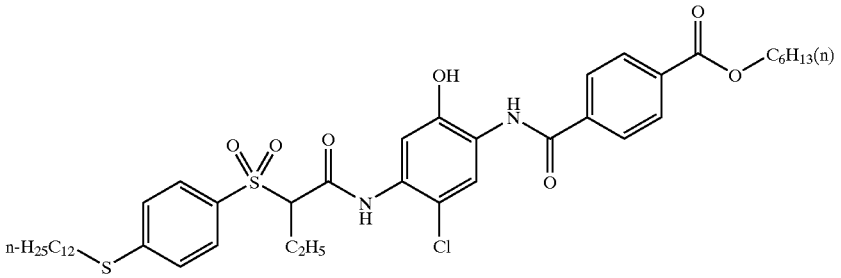
I-7
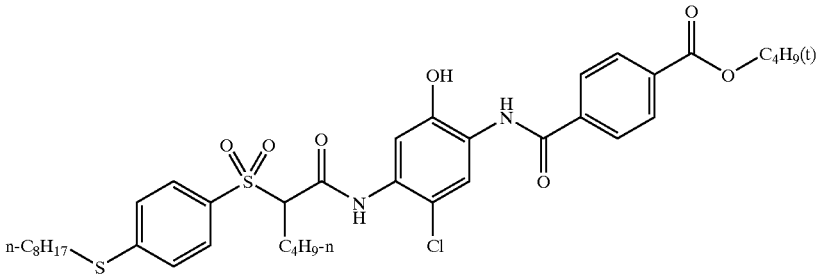
I-8
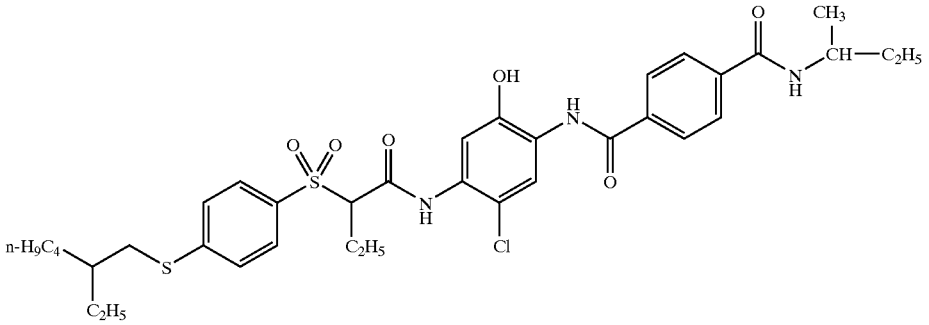
I-9
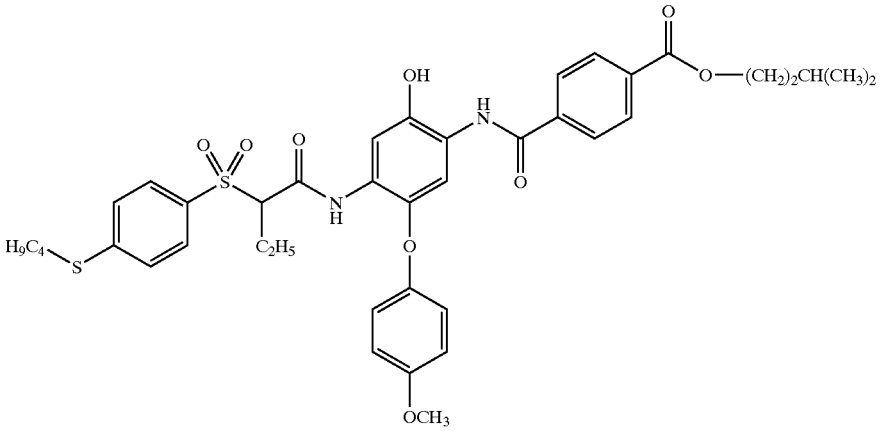

-continued
I-10
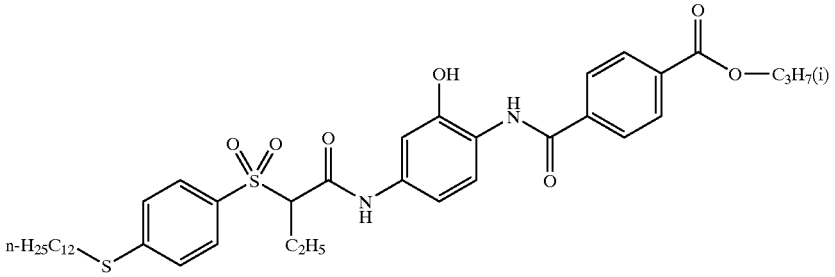
I-11
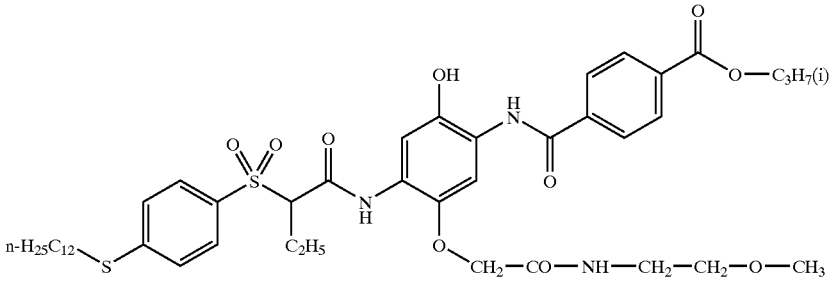
I-12
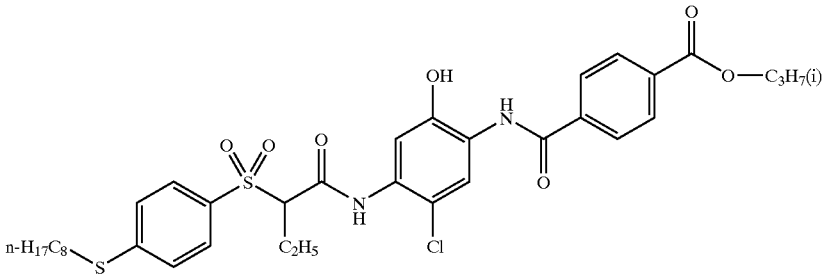
I-13
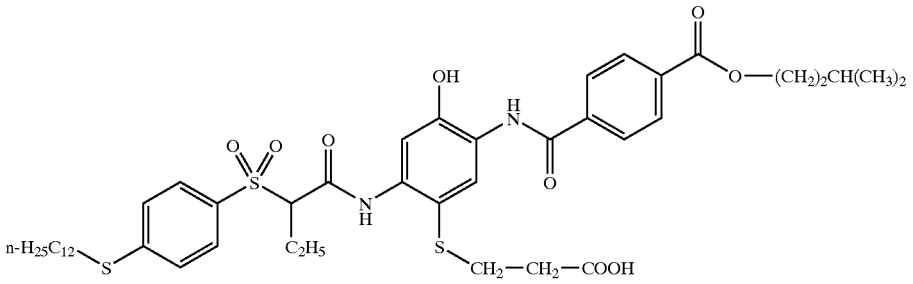
I-14
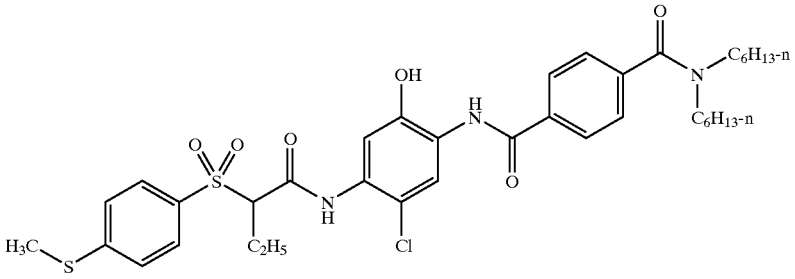

-continued
I-15
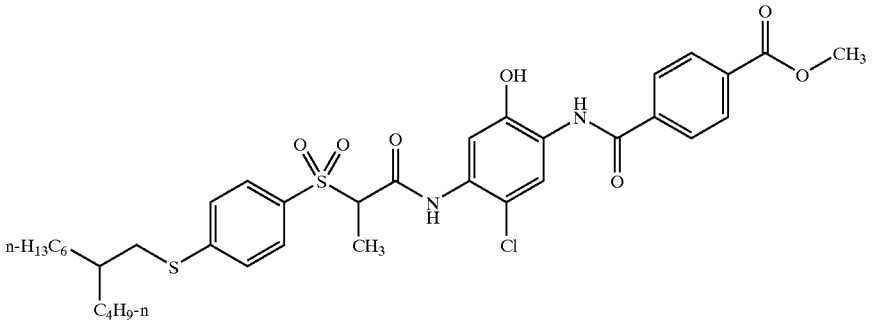
I-16
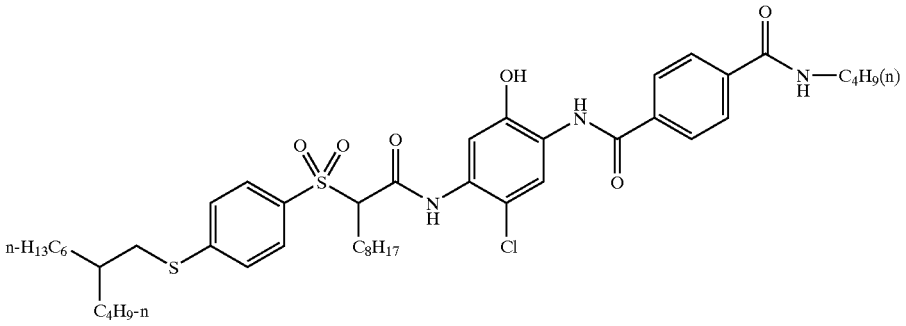
I-17
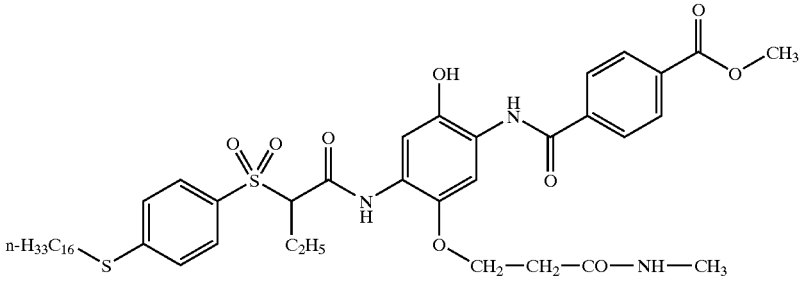
I-18
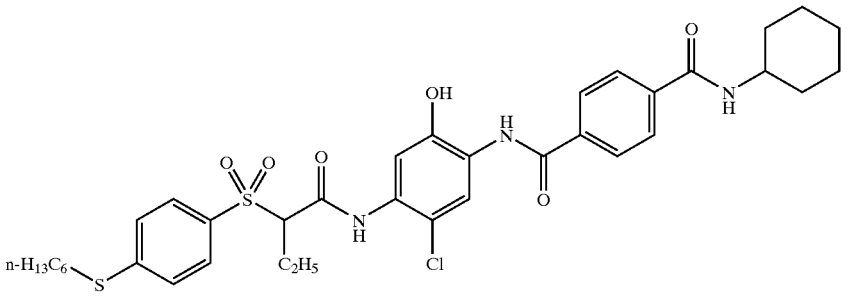
I-19
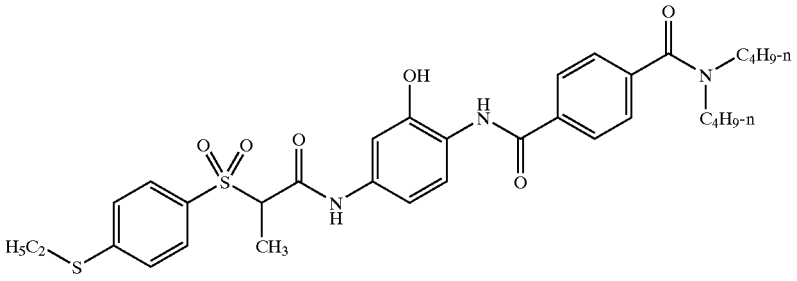

-continued
I-20
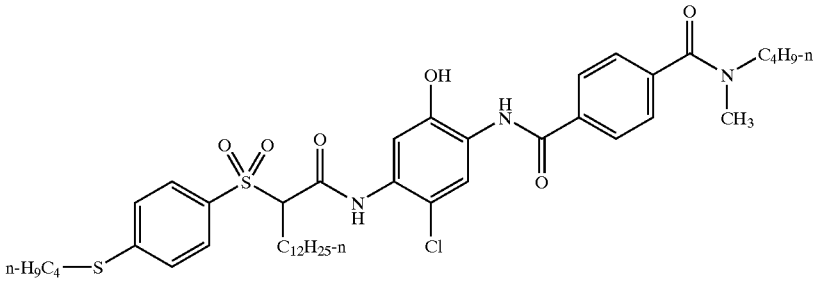
I-21
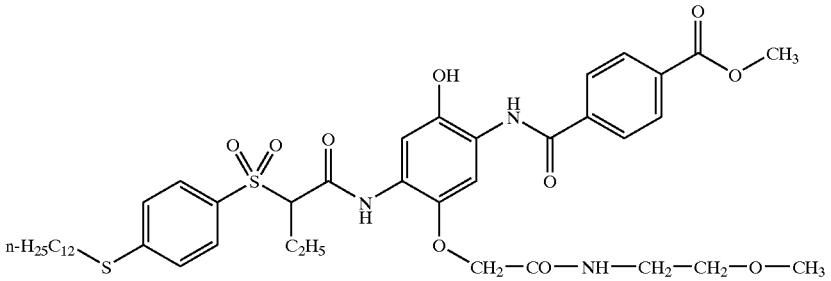
I-22
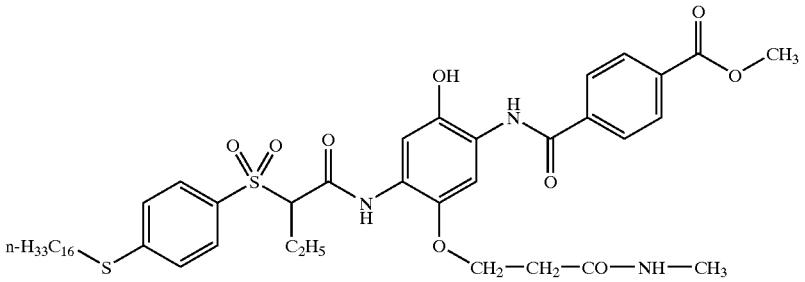
I-23
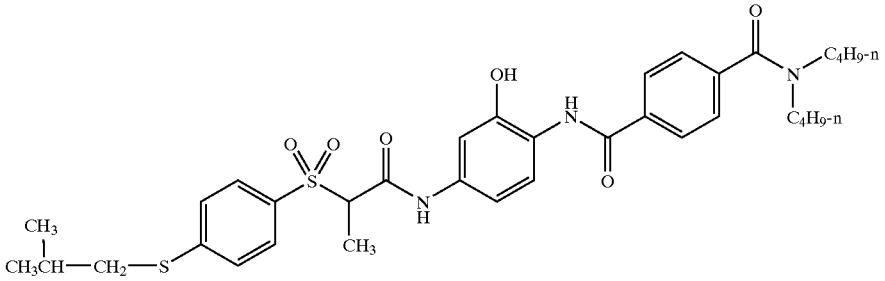
I-24
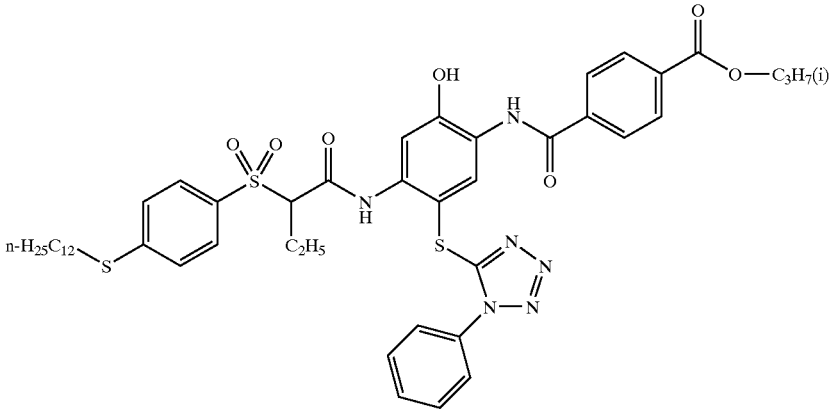

-continued
I-25
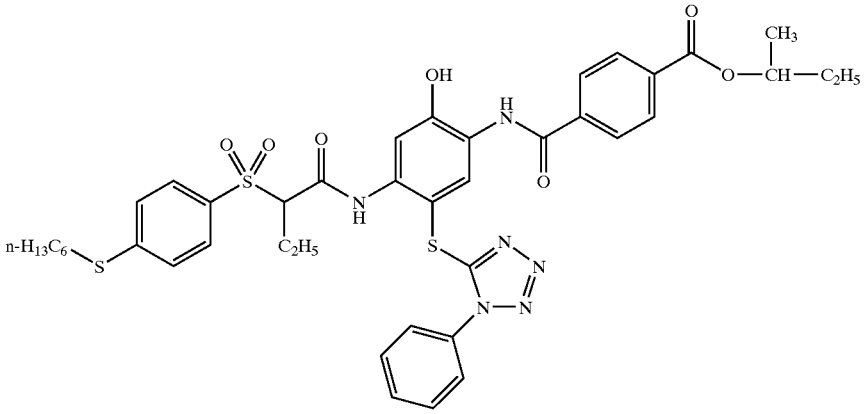
I-26
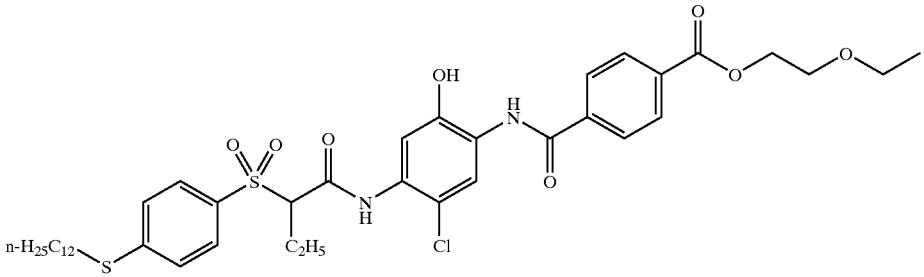
I-27
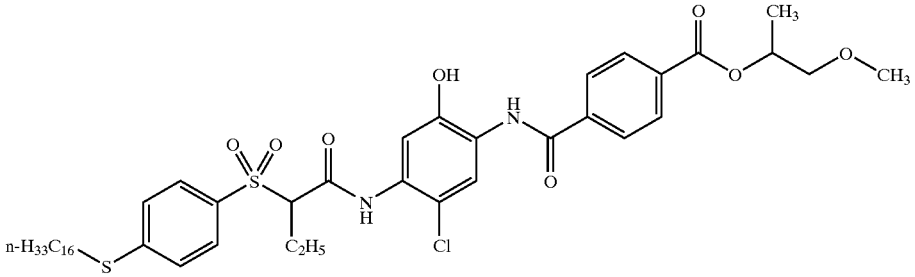
I-28
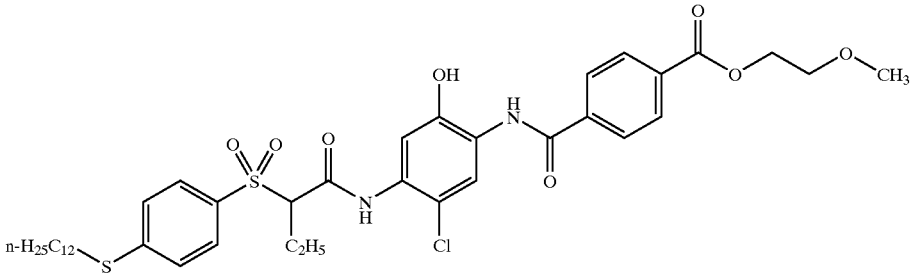
I-29
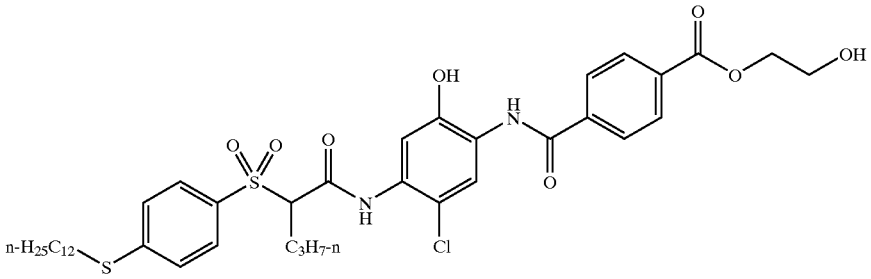

-continued
I-30
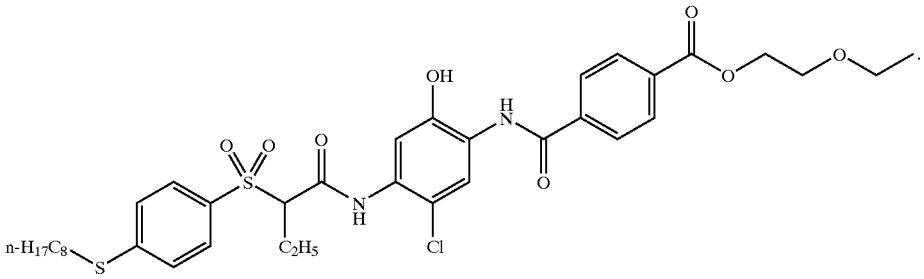
* * * * *